United States Patent [19]

Henson

[11] 4,396,240

[45] Aug. 2, 1983

[54] STORAGE SYSTEM

[76] Inventor: Artel R. Henson, P.O. Box 1487, Green Valley, Ariz. 85614

[21] Appl. No.: 190,582

[22] Filed: Sep. 25, 1980

Related U.S. Application Data

[60] Continuation-in-part of Ser. No. 917,771, Jun. 16, 1978, Pat. No. 4,236,772, which is a division of Ser. No. 761,646, Jan. 24, 1977, Pat. No. 4,095,860.

[51] Int. Cl.[3] ..... A47B 87/00; A47K 4/00

[52] U.S. Cl. ..... 312/237; 312/138 A; 312/228; 312/324; 4/663; 4/664

[58] Field of Search ..... 312/237, 228, 138 A, 312/245, 324, 239; 211/88; 4/662, 663 X, 664 X

[56] References Cited

U.S. PATENT DOCUMENTS

| | | | |
|---|---|---|---|
| 1,642,633 | 9/1927 | Vittengl | 312/235 R |
| 1,978,842 | 10/1934 | Hooton | 4/663 |
| 1,984,977 | 12/1934 | Mize | 312/138 A |
| 2,198,605 | 4/1940 | Faber | 4/663 |
| 2,486,371 | 10/1949 | Mankki | 4/663 |
| 2,515,459 | 7/1950 | Martin et al. | 312/228 |
| 2,557,470 | 6/1951 | Rollie et al. | 4/663 |
| 2,673,132 | 3/1954 | Alderman | 312/239 |
| 2,755,156 | 7/1956 | Nichols | 312/200 |
| 2,931,686 | 4/1960 | Afdal | 312/245 |
| 3,053,602 | 9/1962 | Golenpaul | 312/324 |
| 3,089,745 | 5/1963 | Postula et al. | 312/324 |
| 3,230,549 | 1/1966 | McMurtrie et al. | 4/663 |
| 3,321,258 | 5/1967 | Mackay | 312/324 |
| 3,347,187 | 10/1967 | Khoury | 312/245 |
| 3,462,207 | 8/1969 | Newman et al. | 312/245 |
| 3,791,528 | 2/1974 | Brendgord | 211/88 |
| 3,807,822 | 4/1974 | Amore | 312/138 A |
| 3,978,529 | 9/1976 | Krafft | 4/663 |
| 4,023,320 | 5/1977 | Jackson | 52/473 |

FOREIGN PATENT DOCUMENTS

| | | | |
|---|---|---|---|
| 961806 | 1/1975 | Canada | 312/138 A |
| 1244054 | 9/1960 | France | 160/117 |
| 1379768 | 10/1964 | France | 4/663 |

*Primary Examiner*—Victor N. Sakran

*Attorney, Agent, or Firm*—Harness, Dickey & Pierce

[57] ABSTRACT

A storage system comprising at least one panel member which may be in the form of a hingedly mounted door or the like and including a pair of spaced parallel mounting sections on one side of the door, a plurality of storage containers adapted to be mounted on the panel at selected vertical locations along the mounting sections, and mounting elements extending between the containers and the panel for removably connecting the containers thereto. The panel may comprise one of a plurality of coplanar doors or partitions normally closing an access opening to a storage area, such as a closet, cabinet, bathing unit, vanity or the like, whereby the storage containers are normally hidden from view but are readily accessible upon opening of the doors. The storage system may be embodied in a unitized closet structure which may be placed in its entirety within a recess of suitable dimensions, or a unitized bath, vanity and closet structure which may be installed in its entirety within a building structure, in order to minimize assembly time and effort to the extreme.

51 Claims, 13 Drawing Figures

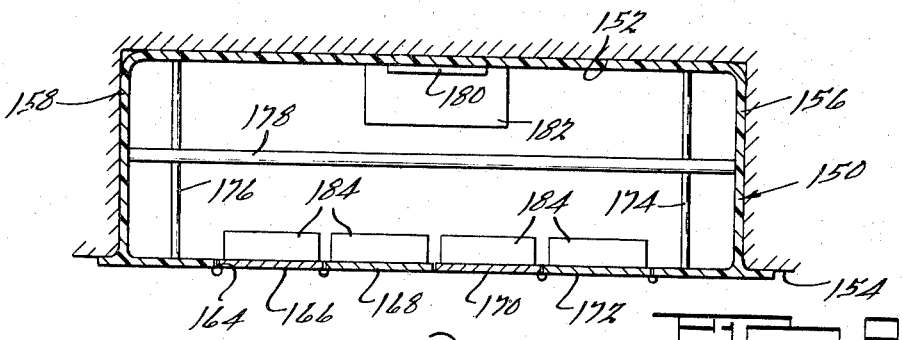
Fig. 9.
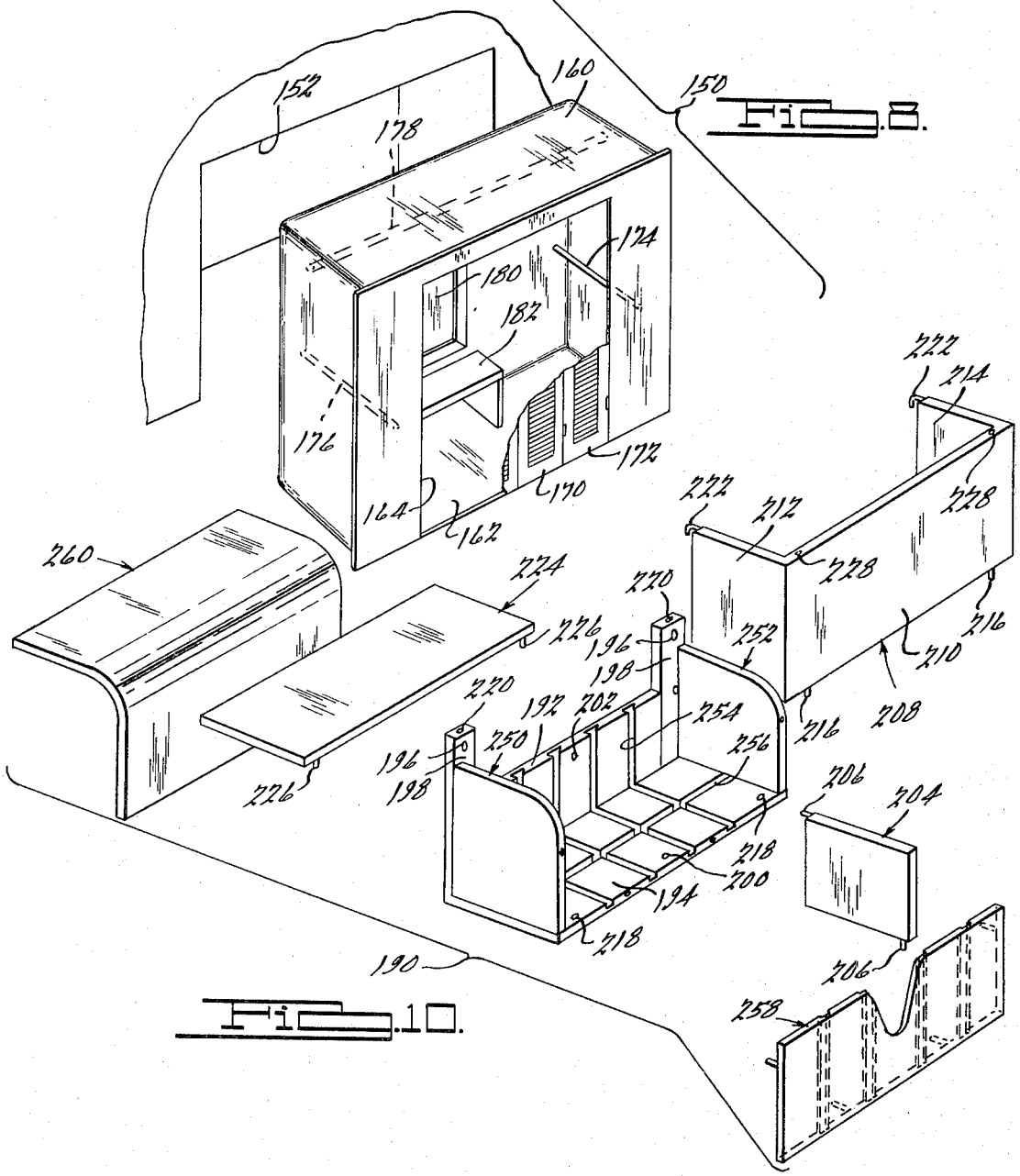
Fig. 8.
Fig. 10.

STORAGE SYSTEM

CROSS-REFERENCE TO RELATED APPLICATIONS

This is a continuation-in-part of application Ser. No. 917,771, filed June 16, 1978, now U.S. Pat. No. 4,236,772 issued Dec. 2, 1980 which is a divisional application of application Ser. No. 761,646, filed Jan. 24, 1977, and which issued June 20, 1978 as U.S. Pat. No. 4,095,860.

SUMMARY OF THE INVENTION

The present invention relates generally to storage systems and more particularly, to a new and improved storage system which may be operatively associated with doors, partitions or the like that function to normally close or cover the access opening to a storage area such as a closet, room etc. It is, therefore, the general object of the present invention to provide a new and improved storage system adapted to be operatively associated with such closure doors.

More specifically, the present invention is directed toward a new and improved storage system which may be mounted directly upon the rearward side of a single door or be incorporated on each of a plurality of coplanar or otherwise arranged doors so as to provide useful storage space in a location which is normally not used for storage. In particular, the present invention contemplates the arrangement of a plurality of storage containers mounted in generally vertical alignment on the interior side of a closet door or the like, whereby when the door is biased about its generally vertical hinge axis to an open position, full access may be had to the storage containers as well as to the interior of the closet. It is accordingly another object of the present invention to provide a new and improved storage system which may be operatively mounted on closet doors and the like.

It is a further object of the present invention to provide a new and improved storage system of the above-described character which may be provided in the form of a panel secured directly to one side of a door or the like and which is provided with a pair of spaced parallel mounting sections upon which the aforesaid plurality of storage containers may be removably secured.

It is still another object of the present invention to provide a new and improved storage system wherein the mounting sections for the storage containers are formed integrally of a molded door structure.

It is still another object of the present invention to provide a new and improved storage system as above-described wherein the storage containers may take the form of shelves, storage bins, etc., and may be utilized for storing a myriad of different articles, materials and items.

It is still another object of the present invention to provide a new and improved storage system which is in the form of a unitized closet structure which may be prefabricated and assembled in its entirety and be adapted for operative installation within a recess or opening of suitable dimensions in order to minimize assembly time and effort.

It is still another object of the present invention to provide a new and improved storage system which is in the form of a unitized bath, vanity and closet structure which may be prefabricated and assembled in its entirety and be adapted for operative installation within a building structure in order to minimize assembly time and effort.

It is a further object of the present invention to provide a storage system of the above character wherein the storage containers embodied therein may utilize common component parts in order to standardize production and minimize component inventory.

It is still a further object of the present invention to provide a new and improved storage system of the above-described type that will find universality of application, which will be economical to commercially manufacture and install, and will have a long and effective operational life.

Other objects and advantages of the present invention will become apparent from the following detailed description, taken in conjunction with the accompanying drawings.

BRIEF DESCRIPTION OF THE DRAWINGS

FIG. 8 is an elevated exploded view, partially broken away of another embodiment of the present invention wherein the storage system is incorporated in a unitized prefabricated closet structure or the like;

FIG. 9 is a transverse cross-sectional view of the structure shown in FIG. 8;

FIG. 10 is an exploded assembly view of one of the storage containers incorporated in the present invention;

DESCRIPTION OF THE PREFERRED EMBODIMENTS

Figure 1:
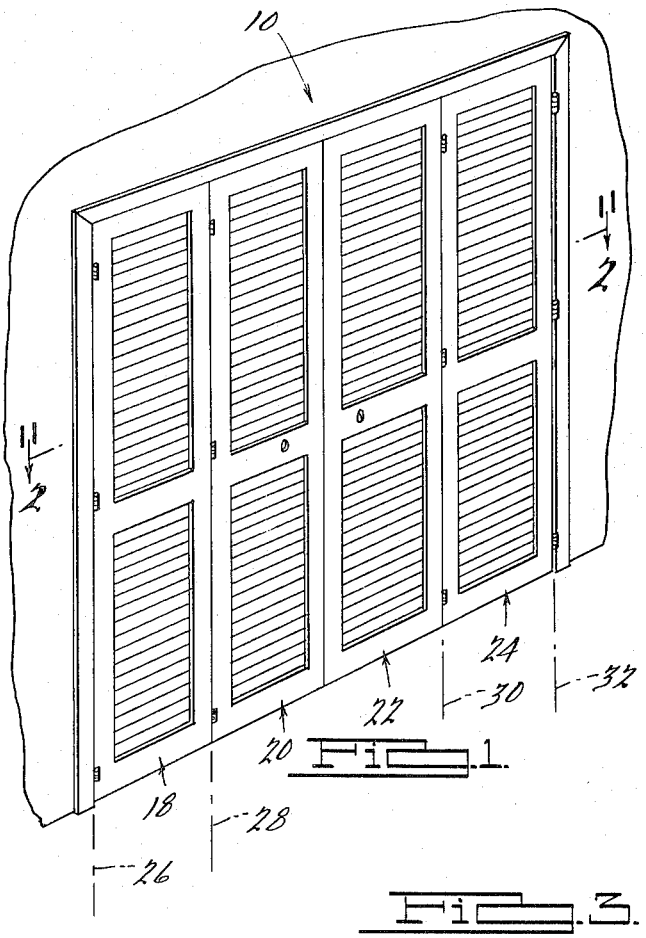
FIG. 1 is an elevated perspective view of a storage system incorporating the principles of the present invention.
Figure 2:
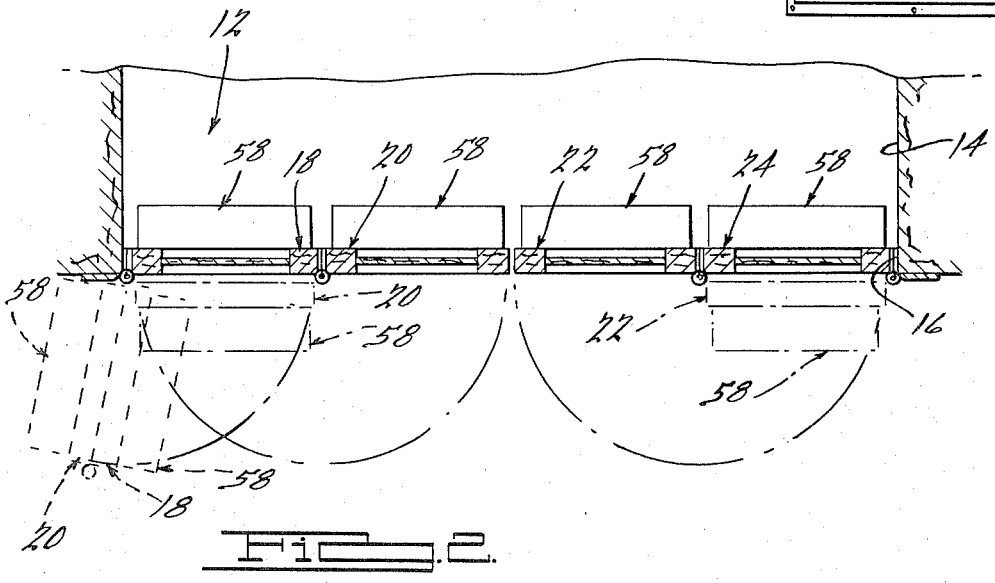
FIG. 2 is a transverse cross-sectional view taken substantially along the line 2—2 of FIG. 1.

Referring now in detail to the drawings and in particular, to FIGS. 1 and 2 thereof, a storage system 10 in accordance with one preferred embodiment of the present invention, is shown in operative association with a storage area generally designated by the numeral 12. The storage area 12 may typically consist of a clothes closet or similar structure 14 having an access opening 16 which is normally closed by one or more doors or similar movable members. By way of example, the access opening 16 of the closet 14 is normally closed by a plurality of coplanar arranged louvered doors 18, 20, 22 and 24 which are arranged in hingedly mounted pairs.

In particular, door 18 is hingedly mounted along a generally vertical axis 26 to one side edge of the opening 16, while door 20 is hingedly mounted along a vertical axis 28 to the opposite side edge of door 18. In a similar manner door 24 is hingedly mounted along a vertical hinged axis 32 to the opposite side edge of the opening 16, and door 22 is hingedly mounted to the door 24 along hinge axis 30. With this arrangement, the doors 20 and 22 may be folded about the axes 28 and 30, respectively, such that the forward (outwardly facing) sides thereof confront the forward (outwardly facing) sides of the aforesaid doors 18 and 24, while the doors 18, 20 and 22, 24 may be folded or pivoted conjointly about the axes 26 and 32 to the fully "open" position shown in FIG. 2. With this arrangement, convenient access is provided to the interior of the closet 14 and at the same time access is provided to the rearward sides of the doors 18–24 for purposes hereinafter to be described.

Figure 3:
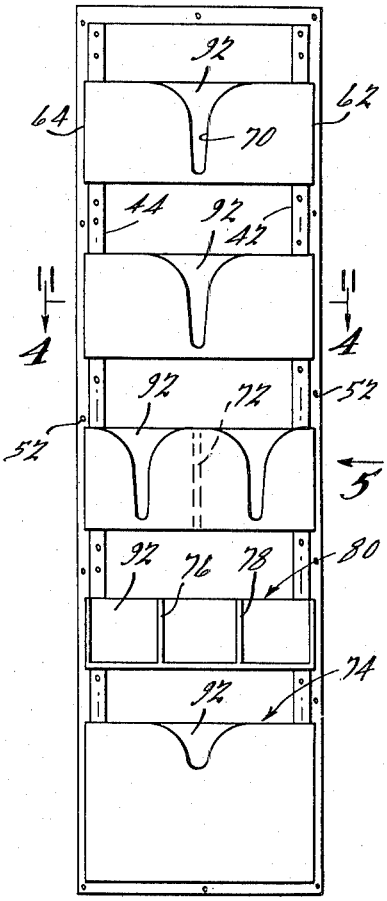
FIG. 3 is an elevational view of one preferred embodiment of the storage system of the present invention.
Figure 4:
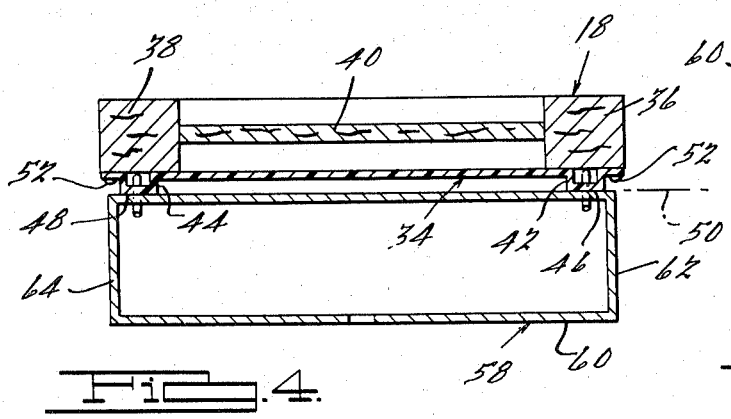
FIG. 4 is an enlarged transverse cross-sectional view taken substantially along the line 4—4 of FIG. 3.

Referring now in detail to FIGS. 3 and 4, in accordance with the principles of the present invention, at least one, and preferably all four of the doors 18–24, is provided with a storage panel member which is generally designated by the numeral 34 and for purposes of illustration is operatively associated with the door 18 which typically comprises a pair of spaced parallel vertically extending rail sections 36 and 38 between which a plurality of louvers, filler panels, etc., 40 extend. The panel member 34 comprises a pair of vertically extending spaced parallel mounting sections 42 and 44 which define mounting surfaces 46, 48, respectively, that lie along an imaginary plane 50 which is spaced slightly away from the plane of the panel member 34. The member 34 is fixedly secured to the door 18 by means of suitable screws, bolts or the like 52 which extend between the outer marginal edges of the member 34 and rails 36, 38 of the door 18. It will be appreciated, of course, that various alternative means may be utilized for operatively securing the panel 34 to the door 18, such as by a suitable adhesive or the like (not shown). Preferably, however, the panel member 34 is coextensive of the entire side of the associated door 18, as best seen in FIG. 3, although for certain applications, it may be desired to have the panel member 34 extend only partially or a fraction of the entire length of the door 18, as will be appreciated by those skilled in the art.

Figure 5:
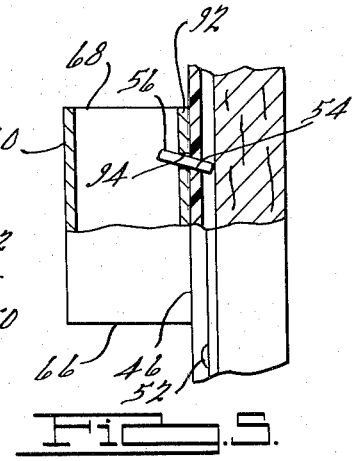
FIG. 5 is a fragmentary side elevational view of the structure shown in FIG. 3, as seen in the direction of the arrow 5 thereof.

The mounting sections 42, 44 of the panel member 34 and in particular, the surfaces 46, 48 thereof define pairs of laterally aligned apertures or bores, generally designated by the numeral 54 which, as best seen in FIG. 5, are inclined slightly upwardly toward the rearward sides of the doors 18–20. The bores 54 are adapted to nestingly receive mounting elements, generally designated by the numeral 56, which are generally rod-shaped or of a dowel configuration and are adapted to operatively support hereinafter to be described storage containers, generally designated by the numeral 58, upon the associated panel member 34.

Figure 7:
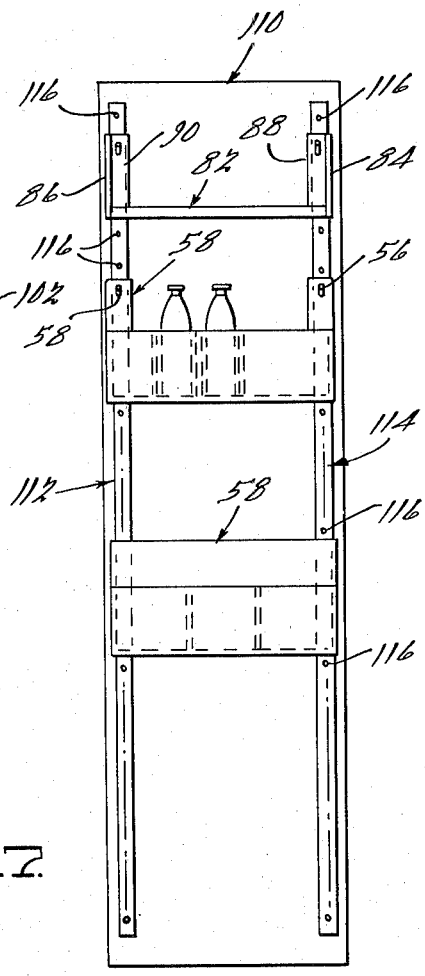
FIG. 7 is a view similar to FIG. 3 and illustrates yet another embodiment of the present invention.

As best seen in FIGS. 3 and 7, the storage containers 58 may be of a variety of different constructions but are all preferably of a generally parallelepiped or rectangular configuration having front portions 60, side portions 62, 64 and a bottom portion 66. The containers may have an open upper side or top 68 into which articles to be stored may be inserted, and the front portions or sides 60 thereof may be cut away, as seen at 70 in FIG. 3, to facilitate removal of the articles. If desired, suitable partitions, as indicated at 72 in FIG. 3, may be provided for separating articles within the containers 58, and the containers 58 may be relatively shallow (for storing small articles), or relatively deep as indicated at 74 in FIG. 3. If desired, multiple partitions 76, 78 may be utilized in the containers 58 and the forward sides 60 thereof may be removed in order to provide convenient access and removal of articles as indicated in the container 80 in FIG. 3. If desired, the storage containers may merely consist of a shelf or horizontal platform 82 as seen in FIG. 7, having a pair of end members 84, 86 and rearwardly extending back flanges 88, 90. A preferred construction of the storage containers is depicted in FIG. 10 and hereinafter described. Regardless of the relative size, dimension, number and type of access openings and/or internal partitions, each of the storage containers 58 is provided with a back or rearward side, as indicated at 92 in FIG. 5 (or in the case of the shelf 82, the back flanges 88, 90). Formed in the rearward side 92 is a pair of openings or apertures 94 which are spaced apart a distance equal to the space between the mounting sections 42, 44 and are adapted to align with the apertures 54 formed therein, whereby the outer ends of the mounting elements 56 may extend through the apertures 94 and thereby support the containers 58 upon the panel member 34. By virtue of the upwardly inclined orientation of the mounting elements 56, the various storage containers 58 will be mounted in tight contiguous engagement with the surfaces 46, 48 so as to assure that the containers 58 do not become inadvertently disassembled from the panel member 34, as will be appreciated by those skilled in the art.

Figure 6:
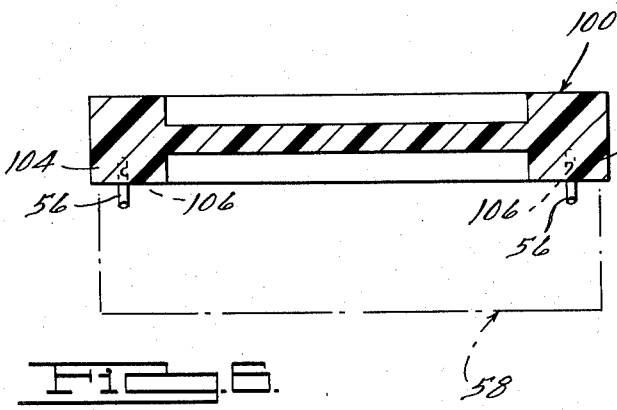
FIG. 6 is a view similar to FIG. 4 and illustrates an alternate embodiment of the present invention.

FIG. 6 illustrates a slightly modified embodiment of the present invention wherein a door 100 is fabricated of a molded material, such as a suitable rigid (or reinforced) polyurethane foam or the like and comprises a pair of spaced parallel vertically extending mounting sections 102 and 104. As will be apparent, the mounting sections 102, 104 are formed integrally of the door 100 and as such obviate the need for having an entire panel, such as the panel 34, secured to the door per se. The mounting sections 102, 104 are formed with a plurality of laterally spaced pairs of aligned bores 106 which are analogous to the aforementioned bores 54, and like the bores 54, are inclined upwardly slightly and adapted to receive the ends of associated mounting elements, such as the mounting elements 56, whereby one or more of the aforediscussed storage containers 58 may be mounted at selected vertical positions along the door 100.

FIG. 7 illustrates yet another embodiment of the present invention where a standard door 110 may be adapted to the principles of the present invention through the provision of a pair of mounting strips 112 and 114 which are mounted in the spaced parallel relationship on one surface of the door 110. The strips 112, 114 may be secured to the door 110 by any suitable means, such as screws, bolts, adhesive, etc., and are provided with a plurality of aligned blind bores 116 adapted to receive mounting elements 56 which function to support storage containers 58.

It is to be noted that while particular reference has been made herein to the specific application of the present invention to the door per se, the present invention is not necessarily so limited in view of the fact that the principles of the present invention could be applied satisfactorily to any suitable partition, vertical wall surface of the like whereby to achieve the objects of the present invention, namely, to provide storage space at a location where suitable storage facilities were previously unavailable. This object is particularly satisfied in connection with the door arrangement shown in FIGS. 1–3 wherein doors 18–24 normally close at access opening 16 to the closest 14. When the doors 18–24 are in their closed position, all of the storage containers 58 are entirely hidden from view so as to not be objectionable from an aesthetic standpoint. However, through simple manipulation or opening of the respective doors, complete access may be had to all of the storage containers 58 for purposes of removing articles from or replacing articles thereinto. By virtue of the fact that the containers 58 do not extend any significant distance into the closet 14, there is no interference whatsoever with the articles which are normally stored therein, such as hanging clothes, etc. Consequently, the present invention significantly enhances or supplements existing storage space without in any way interferring with articles which are normally stored therein.

Referring now in detail to FIGS. 8 and 9, another embodiment of the present invention is shown in the form of the unitized storage structure, generally designated 150, which is in the form of a totally prefabricated or preassembled structure adapted to be operatively mounted within a rough opening or recess 152 formed in a wall or similar structure 154. The structure 150 includes spaced apart sides 156, 158, top 160, bottom 162 and defines a forwardly exposed access opening 164. As in the case with the opening 16, the opening 164 is adapted to be closed by louvered or similar type doors 166, 168, 170 and 172 which are preferably, although not necessarily, hingedly mounted in the same manner as the doors 18–24. Preferably, the entire storage structure 150 is fabricated of molded fiberglass, plastic or the like so that it may be entirely preassembled and have the doors 166–172 prehung or mounted therein preparatory to assembly within the recess 152 in much the same way as molded fiberglass tub and shower enclosures are pre-manufactured and assembled. The dimensions of the structure 150 may vary, of course, depending upon the application thereof, although in the embodiment disclosed herein, the depth and width thereof are sufficient to accommodate a pair of transverse closet bars 174, 176 and a laterally extending closet bar 178 upon which clothes or similar articles may be hung in a manner well known in the art. If desired, the structure may be provided with an interior mirror or the like 180 and have a stool or similar structure 182 provided, which stool 182 may be combined with a shoe rack or the like.

As will be appreciated by those skilled in the art, by having the storage structure entirely premanufactured, installation time and effort will be minimized to the extreme and that it will merely be necessary to place the structure 150 into the recess or opening 152 and secure the structure 150 in place by any suitable means, i.e., screws, nails, adhesive, etc.

The doors 166–172 are preferably, although not necessarily, of the type shown in FIG. 6 and as such are adapted to have a plurality of storage containers 184 located at selected vertical locations or positions on the rearward or interior sides thereof. The storage containers 184 may take the form of any of the containers 58 hereinbefore described or alternatively, may take the form of the preferred construction shown in FIG. 10 wherein a storage container, generally designated by the numeral 190 is shown as comprising a generally vertically disposed back member 192 which is connected at the lower edge thereof to a generally horizontally arranged bottom member 194. The back member 192 includes a pair of openings 196 formed in a pair of upstanding leg sections 198 which are intended to cooperate with suitable mounting elements (not shown) such as the aforedescribed dowel or rod-shaped mounting elements 56, in securing the container 190 to the associated door. As will be appreciated, the container 190 may be used merely as a storage shelf in the form depicted in FIG. 10, or if desired, one or more partition members, such as the member 204, may be operatively associated with the back and bottom members 192, 194 in providing a partitioned shelf. By way of example, openings 200 and 202 may be formed in the members 194 and 192, respectively, and adapted for cooperation with complementary-shaped lugs or bosses 206 on the partition member 204 for securing the latter in place. If desired, multiple partition members may be utilized when necessary.

If it is desired to convert the container 190 to a partially enclosed container, an enclosure member, such as is designated by the numeral 208, may be operatively associated with the members 192, 194. The enclosure member 208 includes a front or forward side 210 and opposed end portions 212 and 214. The enclosure member 208 is adapted to be surmounted upon the bottom member 194 for providing a partially enclosed container, with downwardly directed lugs or bossses 216 being receivable within complementary-shaped openings 218 in the bottom member 194 and rearwardly directed hooks or the like 222 on the enclosure member 208 being operatively received within suitable recesses or openings 220 on the leg portions 198. If desired, a suitable dust cover member or the like 224 may be operatively associated with the members 192, 194 and 208 for providing a totally enclosed container. Such a cover member 224 may be provided with lugs or bosses 226 which are cooperative with complementary-shaped bores or openings 228 for securing and properly orienting the cover member 224.

Alternatively, a pair of end members 250, 252 may be located at the opposite ends of the container 190 and be secured therein in the same manner as the aforementioned end portions 212, 214 of the enclosure member 208. A plurality of dove-tailed or other suitably shaped slots 254 and 256 may be provided in the members 192, 194 for cooperating with a front plate or side member 258 in supporting one or more partition members, such as the member 204. As will be appreciated, the aforementioned bosses and boss receiving recesses or bores may, for certain applications, be eliminated by properly designing the edges of the partition member(s) 204 to slide into the slits 254, 256. The container 190 consisting of the members 192, 194 and end members 250, 252 may be enclosed by a suitable dust cover or closure member 260 which may, if desired, be transparent to permit viewing of the interior of the container. Suitable securing means, such as fastening bosses or the like (not shown) may be cooperative with the openings 218, etc., in operatively securing the dust cover 260 in place.

The various members 192, 194, 204, 208, 224, 250, 252, 258, and 260 are preferably fabricated of a molded plastic material or the like and are adapted to provide universality of application by standardizing as many component parts of the storage containers 190 as possible yet provide maximum versatility for storing articles of different sizes and shapes. With the arrangement described above, it is possible to provide a storage system consisting merely of a plurality of shelves and to later convert such shelves to storage containers (either partially or totally enclosed) through the utilization of additional members 208, 204, 224, as will be appreciated by those skilled in the art.

Figures 11, 12, 13:
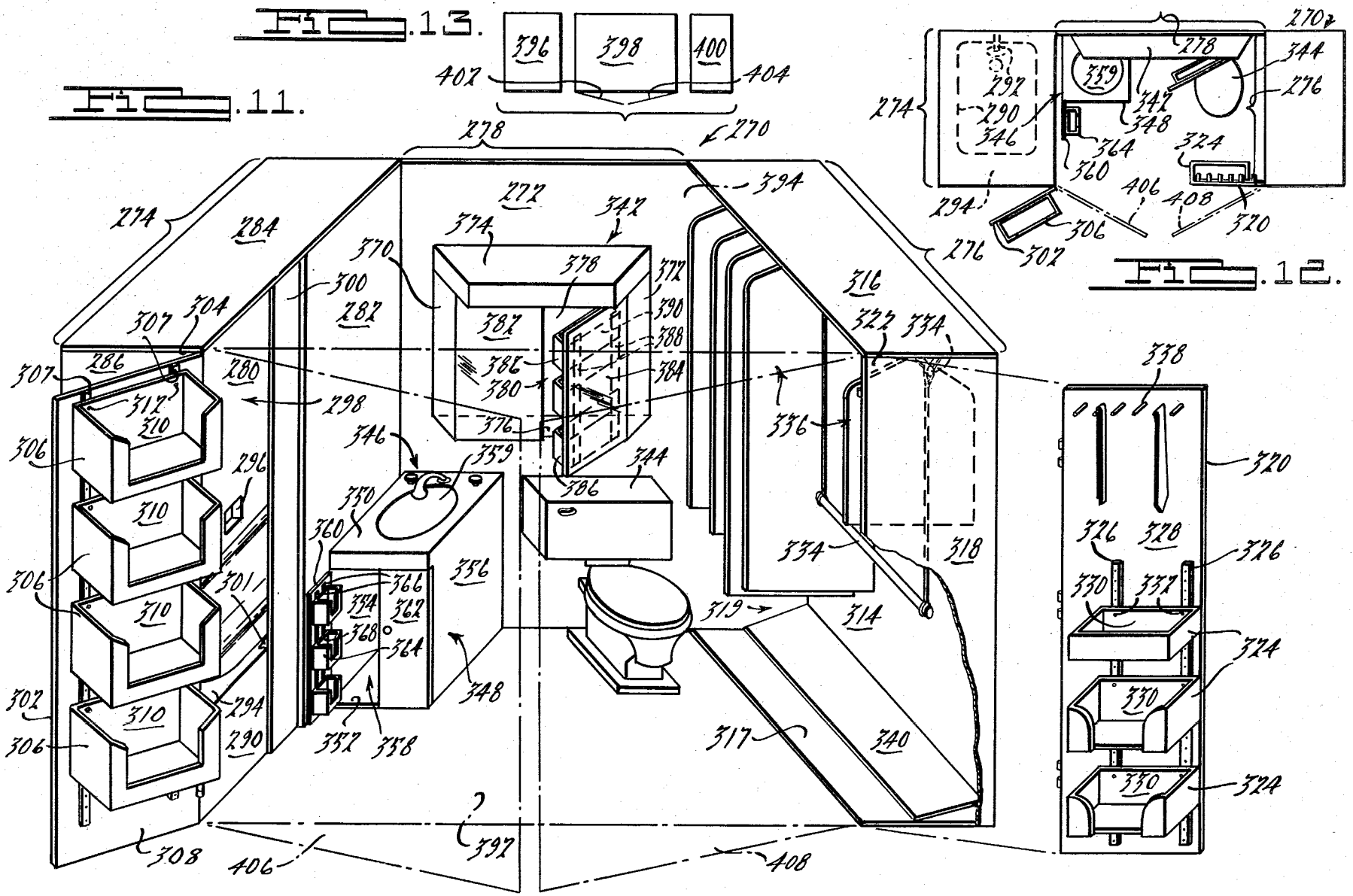
FIG. 11 is a distorted perspective view of another embodiment of the present invention wherein the storage system is incorporated in a unitized prefabricated bath, vanity and closet structure.
FIG. 12 is a plan view of the structure shown in FIG. 11.
FIG. 13 is a plan view of another embodiment of a prefabricated bath, vanity and closet structure in accordance with the present invention.

Yet another embodiment of the present invention is illustrated in FIGS. 11 and 12. This embodiment of the invention is shown generally at 270 in the form of a unitized bath, vanity and closet structure. As with the storage structure 150 shown in FIGS. 8 and 9, the structure 270 is intended to be prefabricated or preassembled and is adapted to be operatively mounted within or as part of a building structure or room (not shown). To effect installation, it is only necessary to place the structure 270 into a room or building structure and secure the structure 270 in place relative to the wall, floor and/or ceiling structure by any suitable means, such as by screw, nails, adhesive, etc. Preferably, the entire structure 270 is fabricated of molded fiberglass, plastic or the like so that it may be entirely preassembled, with the associated fixtures and doors described below prehung or mounted therein preparatory to installation in a room or the like to minimize installation time and effort.

The structure 270 includes a generally rectangular vertical back wall or structural panel 272 which comprises part of and rigidly supports three functional subunits or substructures. As shown in FIGS. 11 and 12, these substructures define a bathing unit 274 at one lateral end of panel 272, a closet unit 276 at the other lateral end of panel 272, and a vanity unit 278 spaced between the bathing unit 274 and closet unit 276.

The bathing unit 274 includes a pair of spaced sidewalls 280 and 282 and a top 284 which extend generally perpendicular to panel 272. The longitudinal ends of the bathing unit 274 are defined by panel 272 and an endwall 286, and cooperate with sidewalls 280 and 282 and top 284 to define an enclosure within which a premanufactured bathtub 290 and shower unit 292 are contained. One end of the bathtub 290 can be formed to include a seat 294, and sidewall 280 can be formed with a soap receptacle 296, if desired. As shown in FIG. 11, sidewall 282, top 284 and endwall 286 cooperate to define an access opening 298 to the enclosure for permitting entry to and exit from the bathtub 290 and/or shower unit 292. The access opening 298 can be closed during use of the bathtub 290 and/or the shower unit 292 by a sliding door 300. The sliding door 300 can be provided with a flashing 301 on the interior surface thereof above bathtub 290 to preclude water run-off onto the floor.

When the bathing unit 274 is not in use, the access opening 298 is adapted to be at least partially closed by a door 302 which is preferably, although not necessarily, hingedly mounted adjacent end 304 of endwall 286. The door 302 is adapted to have a plurality of storage containers 306 located at selected vertical locations or positions along mounting sections or strips 307 disposed on face 308 of the door 302. The back member 310 of each storage container 306 includes a pair of openings 312 which are intended to cooperate with suitable mounting elements (not shown), such as the previously-described dowel or rod-shaped mounting elements 56, in removably securing the container 306 to the mounting sections 307 along face 308 of the door 302.

The closet unit 276 includes a sidewall 314, a top 316 and a bottom 317 which extend generally perpendicular to panel 272. The longitudinal ends of the closet unit 276 are defined by panel 272 and an endwall 318, and cooperate with sidewall 314, top 316 and bottom 317 to define an access opening 319 to the closet unit 276 for permitting access thereto. The access opening 319 is adapted to be at least partially closed by a door 320 which is preferably, although not necessarily, hingedly mounted adjacent end 322 of endwall 318. FIG. 12 illustrates the door 320 in its closed position. As with door 302 of bathing unit 274, door 320 is adapted to have a plurality of storage containers 324 located at selected vertical locations or positions along mounting sections or strips 326 disposed on face 328 of the door 320. In accordance with the invention, the back member 330 of each storage container 324 includes a pair of openings 332 which are intended to cooperate with suitable mounting elements (not shown), such as the previously-described mounting elements 56, in removably securing the container 324 to the mounting sections 326 along face 328 of door 320.

The dimensions of the closet unit 276 may vary, of course, depending upon the application thereof, although in the embodiment disclosed herein, the depth and width thereof are sufficient to accommodate a pair of longitudinally extending closet bars 334 upon which clothes 336 or other similar articles may be hung in a manner well known in the art. The closet unit 276 may also be provided with a tie and belt rack 338 along face 328 of door 320, and be provided with a shoe rack or the like 340 such as shown in FIG. 11.

The vanity unit 278 is defined by the area of structure 270 disposed laterally between bathing unit 274 and closet unit 276. As shown in FIGS. 11 and 12, vanity unit 278 includes a wall cabinet 342, a toilet unit 344, and a sink-cabinet unit 346 which are preassembled with panel 272.

The sink-cabinet unit 346 includes a storage cabinet 348 defined by a countertop 350, a bottom 352 and a pair of spaced sidewalls 354 and 356 which extend generally perpendicularly to panel 272. One longitudinal end of storage cabinet 348 is defined by panel 272. The countertop 350, bottom 352 and sidewalls 354 and 356 cooperate to define an access opening 358 at the opposite longitudinal end of storage cabinet 348 for permitting access thereto. The sink-cabinet unit 346 includes a sink 359 which can be mounted within countertop 350 in any conventional manner. As shown in FIG. 11, access opening 358 is adapted to be closed by a pair of doors 360 and 362 which are preferably, although not necessarily, hingedly mounted upon sidewalls 354 and 356. Each of these doors 360 and 362 is adapted to have a plurality of storage containers 364 located at selected vertical locations or positions along mounting sections or strips 366 disposed on the interior faces of doors 360 and 362. Each storage container 364 includes a back member 368 provided with a pair of openings which are intended to cooperate with suitable mounting elements, such as mounting elements 56, in removably securing the container 364 on mounting sections 366.

The wall cabinet 342 includes a pair of spaced sidewalls 370 and 372, a top 374 and a bottom 376 which extend outwardly from panel 272. The wall cabinet 342 also includes a backwall 378 which is defined by either panel 272 or a separate panel member. As illustrated in FIG. 11, sidewalls 370 and 372, top 374, bottom 376 and backwall 378 cooperate to define an access opening 380 to the wall cabinet 342 for permitting access thereto. The access opening 380 is adapted to be closed by a pair of doors 382 and 384 which are preferably, although not necessarily, hingedly mounted upon sidewalls 370 and 372. Each of these doors 382 and 384 is adapted to have a plurality of storage containers 386 located at selected vertical locations on positions along mounting sections or strips 388 disposed on the interior faces of doors 382 and 384. Each storage container 386 includes a back member 390 provided with a pair of openings which are intended to cooperate with suitable mounting elements, such as mounting elements 56, in removably securing the container 386 on mounting sections 388.

As is readily apparent, the structure 270 not only provides the previously-noted assembly and installation advantages, but also provides storage space at locations where suitable storage facilities were previously unavailable. Moreover, this embodiment of the present invention significantly enhances or supplements existing storage space without in any way interfering with articles which are normally stored in such storage spaces. More specifically, the structure 270 provides three functional substructures 274, 276 and 278 having doors 302, 320, 360, 362, 382 and 384 which normally close access openings 298, 319, 358 and 380 to these substructures. When these doors are in their closed positions, all of the respective storage containers 306, 324, 364 and 386 are entirely hidden from view and are therefore unobjectionable from an aesthetic viewpoint. However, through simple manipulation or opening of the respective doors, complete access may be had to any and all of the storage containers 306, 324, 364 and 386 for purposes of removing articles from or replacing articles thereinto. By virtue of the fact that the containers 306, 324, 364 and 386 do not extend any significant distance into bathing unit 274, closet unit 276, or the wall cabinet 342 and sink-cabinet unit 346 of vanity unit 278, these containers effect no interference with any articles which are normally stored within these structures, such as personal hygiene articles, hanging clothes, etc.

The doors 302, 320, 360, 362, 382 and 384 and mounting sections 307, 326, 366 and 388 can be of any of the previously-described types. More specifically, the doors can be in a form similar to the door 18 having rail sections 36 and 38 and louvers 40, and the mounting sections can be provided in a form similar to storage panel member 34 and mounting sections 42 and 44, such as shown in FIG. 4. Alternatively, the doors and mounting sections can be provided in a form similar to the molded door 100 and integrally formed mounting sections 102 and 104, such as shown in FIG. 6. Additionally, the doors can be provided in the form of a standard door 110, while the mounting sections can be in the form of mounting strips 112 and 114, such as shown in FIG. 7. In any case, the doors and/or mounting sections can be made from metal, wood, molded fiberglass, polyurethane foam, or the like, as desired. The storage containers 306, 324, 364 and 386 illustrated in FIG. 11 are for exemplary purposes only, and can take the form of any of the storage containers described hereinabove. Moreover, the storage containers can be provided in a variety of colors to conform with different types of decor.

In a slightly different form of the unitized bath, vanity and closet structure 270 shown in FIGS. 11 an 12, the structure 270 can be provided with integral floor and/or ceiling panels 392 and 394, respectively, as shown in phantom in FIG. 11. In this variation, floor and ceiling panels 392 and 394 can either be assembled with or formed integrally with the various walls of the structure 270. In either case, if desired, the floor panel 392 could serve as the bottom 352 of sink-cabinet unit 346, as well as the bottom 317 of closet unit 276. Moreover, the ceiling panel 394 could serve as the top 284 of bathing unit 274, as well as the top 316 of closet unit 276.

Another embodiment of a prefabricated bath, vanity and closet structure in accordance with the present invention is illustrated in FIG. 13. This embodiment includes separate and distinct self-supporting bathing, vanity and closet substructures or units 396, 398 and 400, respectively. Each of these substructures 396, 398 and 400 can be provided with the previously-described features and components. This embodiment provides a prefabricated structure having three substructures or units for facilitating shipping. Once shipped, these substructures can be joined at a job site or location to yield a unitized structure similar to structure 270. In this embodiment, the vanity unit 398 is preferably, although not necessarily, provided with integral floor and ceiling panels, as well as a pair of doors 402 and 404 pivotably mounted between the floor and ceiling panels and which can be opened and closed for permitting general access to the vanity unit 398, as well as bathing unit 396 and closet unit 400, as desired. In this connection, the structure 270 illustrated in FIG. 11 can be provided with a pair of doors 406 and 408 (shown in phantom) similar to doors 402 and 404. These doors 406 and 408 are intended to be mounted for pivotal movement between floor panel 392 and ceiling panel 394 to allow access to structure 270 as desired.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. A storage system comprising a prefabricated structure for installation as a substantially unitized assembly within a building structure, said prefabricated structure including a first substructure defining a bathing unit, a second substructure defining a closet unit, and a third substructure defining a vanity unit, wherein at least one of said substructures defines an access opening which is selectively opened and closed by a panel member, said panel member comprising a pair of spaced parallel mounting sections on one side of said panel member and extending generally vertically therealong, a storage container adapted to be mounted on said panel member at selected vertical locations along said mounting sections, and at least two mounting elements extending between said container and said mounting sections for securing said container to said panel member at a selected vertical location.

2. A storage system as set forth in claim 1 wherein said mounting sections define a plurality of laterally aligned pairs of openings and wherein said mounting elements are partially receivable within said openings.

3. A storage system as set forth in claim 2 wherein said mounting elements comprise rod-like members and wherein said openings are inclined upwardly and adapted to telescopically receive one end of said members.

4. A storage system as set forth in claim 1 wherein said panel member comprises a door normally closing an access opening to a storage area, and wherein said mounting sections face the interior of said storage area.

5. A storage system as set forth in claim 4 wherein said storage area is defined by said bathing unit.

6. A storage system as set forth in claim 4 wherein said storage area is defined by said closet unit.

7. A storage system as set forth in claim 4 wherein said storage area is defined by said vanity unit.

8. A storage system as set forth in claim 4 wherein said door comprises a louvered door having a pair of spaced apart vertically extending rails and wherein said mounting sections are generally aligned with said rails.

9. A storage system as set forth in claim 1 wherein said panel member comprises a one piece molded member mounted on a door normally closing an access opening to a storage area.

10. A storage system as set forth in claim 9 wherein said molded member is fabricated of a polymeric material.

11. A storage system as set forth in claim 1 wherein said panel member comprises a one piece molded door normally closing an access opening to a storage area and having mounting sections formed integrally along one side thereof.

12. A storage system as set forth in claim 1 wherein said panel member comprises a door and wherein said mounting sections comprise spaced parallel mounting members affixed to one side of said door for securing said storage container thereto.

13. A storage system as set forth in claim 1 wherein said storage container comprises a horizontal portion providing an article supporting shelf.

14. A storage system as set forth in claim 1 which includes a plurality of storage containers located in vertical alignment.

15. A storage system as set forth in claim 1 which comprises a plurality of vertically aligned storage containers, each of said containers having a pair of horizontally aligned openings which are adapted to be aligned with selected pairs of openings formed in said mounting sections, and which includes a pair of rod-like mounting elements extending through associated aligned pairs of openings for securing said containers upon said mounting sections.

16. A storage system as set forth in claim 1 wherein said storage container comprises a bottom member and means for supporting said bottom member on said panel member.

17. A storage system as set forth in claim 16 which includes an enclosure member cooperative with said bottom member for defining a partially enclosed container and means for orienting and securing said enclosure member relative to said bottom member.

18. A storage system as set forth in claim 17 which includes a dust cover member covering the upper side of said container and means for orienting and securing said dust cover member relative to said bottom member and said enclosure member.

19. A storage system as set forth in claim 16 which includes partition means positionable upon said bottom member for providing partitions between storage areas thereon and means including cooperative lug and lug receiving means for securing said partition means relative to said bottom member.

20. A storage system comprising a prefabricated structure for installation as a substantially unitized assembly within a building structure, said prefabricated structure including a first substructure defining a bathing unit, a second substructure defining a closet unit, and a third substructure defining a vanity unit, wherein said bathing unit defines an access opening and includes a panel member operative to at least partially close said access opening, said panel member comprising a pair of spaced parallel mounting sections on one side of said panel member and extending generally vertically therealong, a storage container adapted to be mounted on said panel member at selected vertical locations along said mounting sections, and at least two mounting elements extending between said container and said mounting sections for removably securing said container to said panel member at a selected vertical location.

21. A storage system comprising a prefabricated structure for installation as a substantially unitized assembly within a building structure, said prefabricated structure including a first substructure defining a bathing unit, a second substructure defining a closet unit, and a third substructure defining a vanity unit, wherein said closet unit defines an access opening and includes a panel member operative to at least partially close said access opening, said panel member comprising a pair of spaced parallel mounting sections on one side of said panel member and extending generally vertically therealong, a storage container adapted to be mounted on said panel member at selected vertical locations along said mounting sections, and at least two mounting elements extending between said container and said mounting sections for removably securing said container to said panel member at a selected vertical location.

22. A storage system comprising a prefabricated structure for installation as a substantially unitized assembly within a building structure, said prefabricated structure including a first substructure defining a bathing unit, a second substructure defining a closet unit, and a third substructure defining a vanity unit, wherein said vanity unit defines an access opening and includes a panel member operative to at least partially close said access opening, said panel member comprising a pair of spaced parallel mounting sections on one side of said panel member and extending generally vertically therealong, a storage container adapted to be mounted on said panel member at selected vertical locations along said mounting sections, and at least two mounting elements extending between said container and said mounting sections for removably securing said container to said panel member at a selected vertical location.

23. A storage system comprising a prefabricated structure for installation as a substantially unitized assembly within a building structure, said prefabricated structure including a first substructure defining a bathing unit, a second substructure defining a closet unit, a third substructure defining a vanity unit, at least one panel member mounted for pivotal movement about a generally vertical axis, a pair of spaced parallel mounting sections on one side of said panel member which extend generally vertically therealong and which comprise a plurality of laterally aligned pairs of openings with each pair of openings defining a vertical station along said mounting sections, a storage container adapted to be mounted on said mounting sections at selected vertical stations therealong, and at least two mounting elements extending between said storage container and said mounting sections and which cooperate with at least one of said pairs of openings to removably secure said storage container to said mounting sections at a selected vertical station.

24. A storage system as set forth in claim 23 wherein said mounting elements are partially receivable within said openings.

25. A storage system as set forth in claim 24 wherein said mounting elements comprise rod-like members and wherein said openings are inclined upwardly and adapted to telescopically receive one end of said members.

26. A storage system as set forth in claim 23 wherein at least one of said substructures defines an access opening which is selectively opened and closed by said panel member.

27. A storage system as set forth in claim 23 wherein said panel member comprises a door normally closing an access opening to a storage area, and wherein said mounting sections face the interior of said area.

28. A storage system as set forth in claim 27 wherein said area is defined by said bathing unit.

29. A storage system as set forth in claim 27 wherein said area is defined by said closet unit.

30. A storage system as set forth in claim 27 wherein said area is defined by said vanity unit.

31. A storage system as set forth in claim 27 wherein said vanity unit includes a wall cabinet and said area is defined by said wall cabinet.

32. A storage system as set forth in claim 27 wherein said vanity unit includes a sink-cabinet structure and said area is defined by said sink-cabinet structure.

33. A storage system as set forth in claim 27 wherein said door comprises a louvered door having a pair of spaced apart vertically extending rails and wherein said mounting sections are generally aligned with said rails.

34. A storage system as set forth in claim 23 wherein said panel member comprises a one piece molded member mounted on a door normally closing an access opening to a storage area.

35. A storage system as set forth in claim 34 wherein said molded member is fabricated of a polymeric material.

36. A storage system as set forth in claim 23 wherein said panel member comprises a one piece molded door normally closing an access opening to a storage area and having said mounting sections formed integrally along one side thereof.

37. A storage system as set forth in claim 23 wherein said panel member comprises a door and wherein said mounting sections comprise spaced parallel mounting members affixed to one side of said door for removably securing said storage container thereto.

38. A storage system as set forth in claim 23 wherein said storage container comprises a horizontal portion providing an article supporting shelf.

39. A storage system as set forth in claim 23 which includes a plurality of storage containers located in vertical alignment.

40. A storage system as set forth in claim 23 which comprises a plurality of vertically aligned storage containers, each of said containers having a pair of horizontally aligned openings which are adapted to be aligned with selected pairs of openings formed in said mounting sections, and which includes a pair of rod-like mounting elements extending through associated aligned pairs of openings for removably securing said containers upon said mounting sections.

41. A storage system as set forth in claim 23 wherein said storage container comprises a bottom member and means for supporting said bottom member on said panel member.

42. A storage system as set forth in claim 41 which includes an enclosure member cooperative with said bottom member for defining a partially enclosed container and means for orienting and securing said enclosure member relative to said bottom member.

43. A storage system as set forth in claim 42 which includes a dust cover member covering the upper side of said container and means for orienting and securing said dust cover member relative to said bottom member and said enclosure member.

44. A storage system as set forth in claim 41 which includes partition means positionable upon said bottom member for providing partitions between storage areas thereon and means including cooperative lug and lug receiving means for securing said partition means relative to said bottom member.

45. A storage system comprising a prefabricated structure for installation as a substantially unitized assembly within a building structure, said prefabricated structure including a first substructure defining a bathing unit, a second substructure defining a closet unit, and a third substructure defining a vanity unit, each said substructure including a storage unit comprising at least one panel member mounted for pivotal movement about a generally vertical axis, a pair of spaced parallel mounting sections on one side of said panel member which extend generally vertically therealong and which comprise a plurality of laterally aligned pairs of openings with each pair of openings defining a vertical station along said mounting sections, a storage container adapted to be mounted on said mounting sections at selected vertical stations therealong, and at least two mounting elements extending between said storage container and said mounting sections and which cooperate with at least one of said pairs of openings to removably secure said storage container to said mounting sections at a selected vertical station.

46. In a prefabricated structure for installation as a substantially unitized assembly within a building structure, a bathing unit which defines an access opening and which includes a panel member operative to at least partially close said access opening, said panel member comprising a pair of spaced parallel mounting sections on one side of said panel member and extending generally vertically therealong, a storage container adapted to be mounted on said panel member at selected vertical locations along said mounting sections, and at least two mounting elements extending between said container and said mounting sections for removably securing said container to said panel member at a selected vertical location.

47. In a prefabricated structure for installation as a substantially unitized assembly within a building structure, a closet unit which defines an access opening and which includes a panel member operative to at least partially close said access opening, said panel member comprising a pair of spaced parallel mounting sections on one side of said panel member and extending generally vertically therealong, a storage container adapted to be mounted on said panel member at selected vertical locations along said mounting sections, and at least two mounting elements extending between said container and said mounting sections for removably securing said container to said panel member at a selected vertical location.

48. In a prefabricated structure for installation as a substantially unitized assembly within a building structure, a vanity unit which defines an access opening and which includes a panel member operative to at least partially close said access opening, said panel member comprising a pair of spaced parallel mounting sections on one side of said panel member and extending generally vertically therealong, a storage container adapted to be mounted on said panel member at selected vertical locations along said mounting sections, and at least two mounting elements extending between said container and said mounting sections for removably securing said container to said panel member at a selected vertical location.

49. A prefabricated structure as set forth in claim 48 wherein said panel member comprises a door normally closing an access opening to a storage area, and wherein said mounting sections face the interior of said area.

50. A prefabricated structure as set forth in claim 48 wherein said vanity unit defines an access opening to a wall cabinet having a storage area therein, said panel member comprises a door normally closing said access opening, and said mounting sections face the interior of said area.

51. A prefabricated structure as set forth in claim 48 wherein said vanity unit defines an access opening to a sink-cabinet structure having a storage area therein, said panel member comprises a door normally closing said access opening, and said mounting sections face the interior of said area.

* * * * *